US006875910B2

(12) United States Patent
Naimish

(10) Patent No.: US 6,875,910 B2
(45) Date of Patent: Apr. 5, 2005

(54) GUITAR BRIDGE FOR IMPROVED SOUND TRANSFER

(75) Inventor: Richard J. Naimish, Denver, CO (US)

(73) Assignee: Warren E. Roh, Littleton, CO (US)

( * ) Notice: Subject to any disclaimer, the term of this patent is extended or adjusted under 35 U.S.C. 154(b) by 413 days.

(21) Appl. No.: 09/765,174

(22) Filed: Jan. 18, 2001

(65) Prior Publication Data

US 2002/0092404 A1 Jul. 18, 2002

(51) Int. Cl.[7] ..... G10D 3/04
(52) U.S. Cl. ..... 84/298
(58) Field of Search ..... 84/298, 299, 297 R, 84/300, 301, 302

(56) References Cited

U.S. PATENT DOCUMENTS

| | | | | |
|---|---|---|---|---|
| 2,972,923 A | | 2/1961 | Fender | |
| 4,031,799 A | | 6/1977 | Fender | |
| 4,281,576 A | | 8/1981 | Fender | |
| 4,960,027 A | | 10/1990 | Dunwoodie | |
| 5,198,601 A | | 3/1993 | McCabe | |
| 5,295,427 A | | 3/1994 | Johnsen et al. | |
| 5,410,936 A | | 5/1995 | Ellsworth et al. | |
| 5,448,935 A | * | 9/1995 | Kosinar | 84/298 |
| 5,503,054 A | | 4/1996 | Ellsworth et al. | |
| 5,600,078 A | | 2/1997 | Edwards | |
| 6,124,536 A | | 9/2000 | Hoshino | |
| 6,133,515 A | * | 10/2000 | Hoshino | 84/298 |

* cited by examiner

*Primary Examiner*—Kimberly Lockett
(74) *Attorney, Agent, or Firm*—Thomas W. Hanson

(57) ABSTRACT

An improved bridge for a guitar or other stringed instrument which offers individual height and length adjustment for each string. The bridge uses adjusters in which one part, the saddle, pivots or rocks, on a fulcrum relative to a supporting part, the anvil. The fulcrum may be incorporated into either part or may be a separate element. The fulcrum is generally perpendicular to the string and extends the full width of the adjuster. This configuration, combined with a close fit at the fulcrum results in a tight fit with minimal linear movement and no axial movement (about the vertical axis) between the parts of the adjuster. The combination of this with the ability to use relatively large elements results in an adjuster, and a bridge, with minimal dampening effect, or energy loss, on the string and improved transfer of sound energy to the sound board of the instrument.

12 Claims, 10 Drawing Sheets

GUITAR BRIDGE FOR IMPROVED SOUND TRANSFER

FIELD OF THE INVENTION

The present invention relates to bridges for stringed instruments and particularly to such bridges which provide for individual height and length adjustment of the strings.

BACKGROUND OF THE INVENTION

In a stringed instrument, such as a guitar or bass guitar, the strings are typically supported at the neck of the instrument and at the bridge, being free to vibrate along their length. Ideally, the supporting points are rigid so that they do not move, flex, or vibrate with the string. Such movement would absorb energy from the string, dampening the sound. The ability of the string to vibrate without dampening is often referred to as a tone sustaining characteristic. Where the instrument utilizes a sound board, the bridge also has the function of transferring the vibrations of the string to the sound board with the minimum of distortion and loss. Both of these requirements are best satisfied by a substantially rigid bridge.

Countering these requirements is a desire for the position of the strings to be adjustable. Musicians have individual preferences for the height of the string above the finger board. The closer the string to the fingerboard, the less effort required in fingering the string. However, if the string is too close, it may buzz against the finger board. Individual height adjustment of the strings is a common approach to meeting the musician's needs.

In an instrument which incorporates frets on the finger board, the octave points of the strings should preferably be aligned with the frets. However, this may not be the case with the instrument as it is originally manufactured. Additionally, the above height adjustment may alter the length of the string, altering the position of the octave points. This suggests that the ability to adjust the length of the strings individually should also be provided to correct the octave point positions.

Traditionally, the string support at the neck of the instrument is fixed, so the above adjustments must be accomplished at the bridge. A wide variety of bridges have been developed and are in use which provide both height and length adjustment for the individual strings. However, this adjustability comes at a cost. The bridge can no longer be a single, rigid piece. Multiple elements must be provided and interconnected to provide the two independent adjustments. Any element which is free to move, linearly or axially, or flex and any connection which allows free play or introduces friction results in a loss of energy and a dampening of the sound. Where sound transfer to the sound board is desired, these losses directly impact the quality and quantity of the sound transferred.

While playing the instrument, the musician's hands and clothing, especially sleeves and cuffs, may frequently come into contact with the bridge, whether incidentally during normal play or intentionally through techniques such as palm muting. Snagged clothing or hands would be detrimental.

There is a need for a bridge which provides individual length and height adjustment for each of the strings while providing a strong, substantially rigid structure. The bridge should resist flexing and movement of any of its individual elements, whether linearly or axially. Ideally the bridge would do so while presenting a smooth snag free face to the musician.

SUMMARY OF THE INVENTION

The present invention is directed to an adjustable bridge for a stringed instrument such as a guitar. It provides individual height and length adjustment for each string with improved rigidity and sound transfer over prior art devices.

According to the invention there is provided an adjuster comprising a saddle and an anvil which pivot relative to each other on a fulcrum on one part which fits into a pivot groove on the other part. A string groove on the saddle receives the instruments string. An adjustment mechanism controls the relative angle between the saddle and anvil and thus the relative height of the string above the anvil. Preferably, the adjustment mechanism is a screw or bolt interconnecting the saddle and anvil at the end opposite the string groove.

According to an aspect of the invention the fulcrum and pivot groove each comprise a portion having a constant radius arc and the radii of these arcs is substantially equal for both the fulcrum and pivot groove. This allows them to pivot without varying the amount or quality of contact between the saddle and anvil.

According to another aspect of the invention, the string groove comprises a semi-circular section with a radius substantially equal to that of the string with which it is used. This serves to minimize energy loss and maximize sound transfer at this interface.

According to yet another aspect of the invention, the saddle and/or anvil may incorporate a string clearance slot which allows the string to pass downward through the adjuster in order to accommodate a string through mounting configuration.

Further in accordance with the invention a base plate may be provided to which the adjusters connect. The base plate may include a bottom plate which supports the adjusters or it may be open on the bottom, allowing the adjusters to directly contact the guitar body. The base plate may include side and end rails or may have only an end rail. Any of the base plate configurations may be used with any of the above adjuster variants.

Yet still further in accordance with the invention, the bottom plate of the base plate may incorporate a curved lower surface to accommodate guitars with curved sound boards and/or a curved upper surface to match the adjuster orientation to a curved finger board on the instrument.

The advantages of such an apparatus are a bridge which provides the requisite length and height adjustment for each string while minimizing energy loss in the string. This provides improved tone sustain characteristics in the instrument. Where sound transfer to the sound board of the instrument is desired (typically in acoustic instruments) the inventive bridge also improves performance in this area.

The above and other features and advantages of the present invention will become more clear from the detailed description of a specific illustrative embodiment thereof, presented below in conjunction with the accompanying drawings.

DETAILED DESCRIPTION OF THE INVENTION

The following discussion focuses on the preferred embodiment of the invention, in which the inventive bridge is attached to a solid body electric bass guitar. However, as will be recognized by those skilled in the art, the disclosed apparatus is applicable to a wide variety of both electric and acoustic guitars and similar stringed instruments. Throughout the following discussion, the use of guitar should be understood to represent any of these instruments.

Glossary

The following is a brief glossary of terms used herein. The supplied definitions are applicable throughout this specification and the claims unless the term is clearly used in another manner.

Adjuster—generally a combination of an anvil, a saddle, and a height adjusting screw which serves a single string.

Anvil—the lower portion of the adjuster which bears against the base plate or guitar body (depending on embodiment) and which supports the saddle. The anvil can slide linearly, providing the length adjustment of the string, but remains substantially parallel to the guitar body.

Base or base plate—the structure which is fixed to the guitar body and to which the adjusters are connected via the length adjusting screws. In the preferred embodiment the base both supports and encloses the adjusters. In alternative embodiments, the base may only enclose the adjusters, or may only provide an attaching point for the length adjusting screws.

Fulcrum—that portion of the saddle (preferred) which is received by the pivot groove in the anvil (preferred) and upon which the saddle pivots.

Pivot groove—the lateral recess in the anvil (preferred) which receives the fulcrum of the saddle.

Rail—generally an edge of the base plate, i.e. a side rail or an end rail.

Saddle—that portion of the adjuster which pivots to effect the height adjustment of the string.

Preferred Embodiment

The disclosed invention is described below with reference to the accompanying figures in which like reference numbers designate like parts. Generally, numbers in the 200's refer to prior art elements or elements in the surrounding environment while numbers in the 100's refer to elements of the invention.

As illustrated and described herein, the inventive bridge uses four adjusters. This number is not critical. Clearly, the bridge can be adapted to any number of strings by varying the number and size of the elements.

Overview

Figure 1:
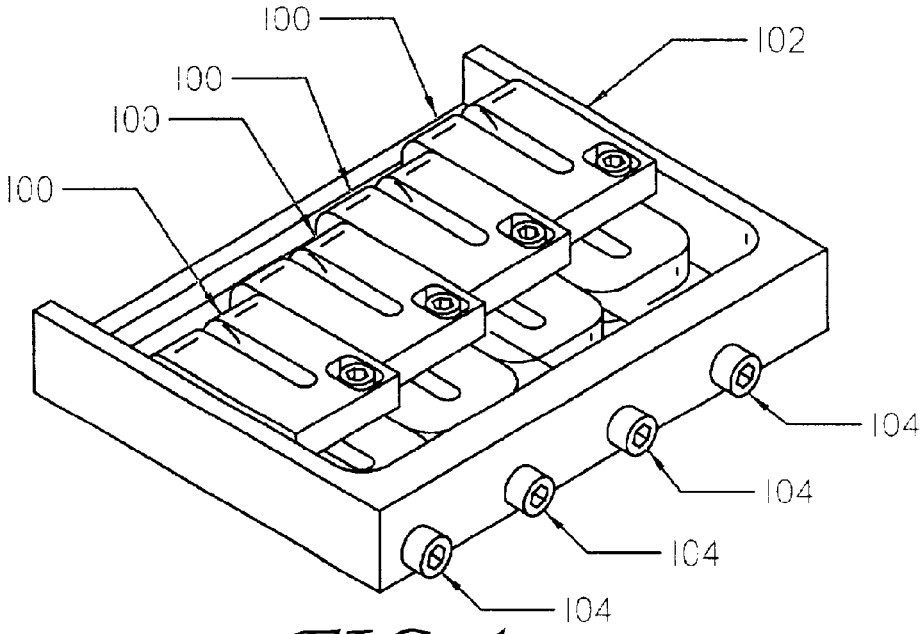
FIG. 1 provides an isometric view of the preferred embodiment of the bridge.
Figure 2:
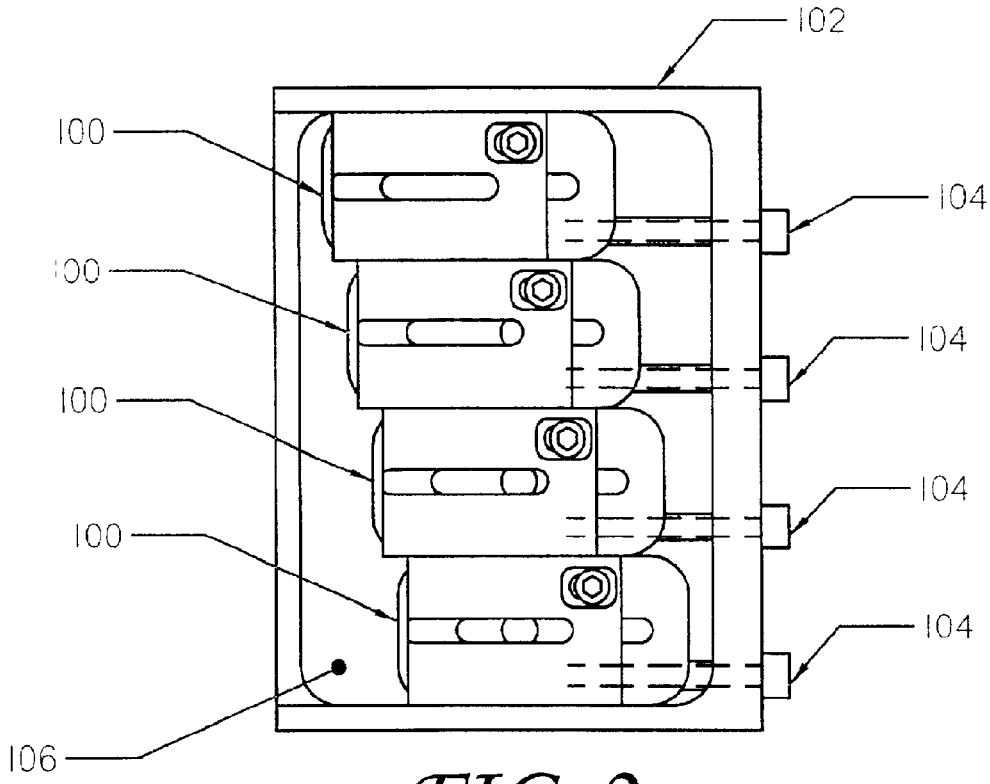
FIG. 2 provides a top view of the preferred embodiment of the bridge.
Figure 3:
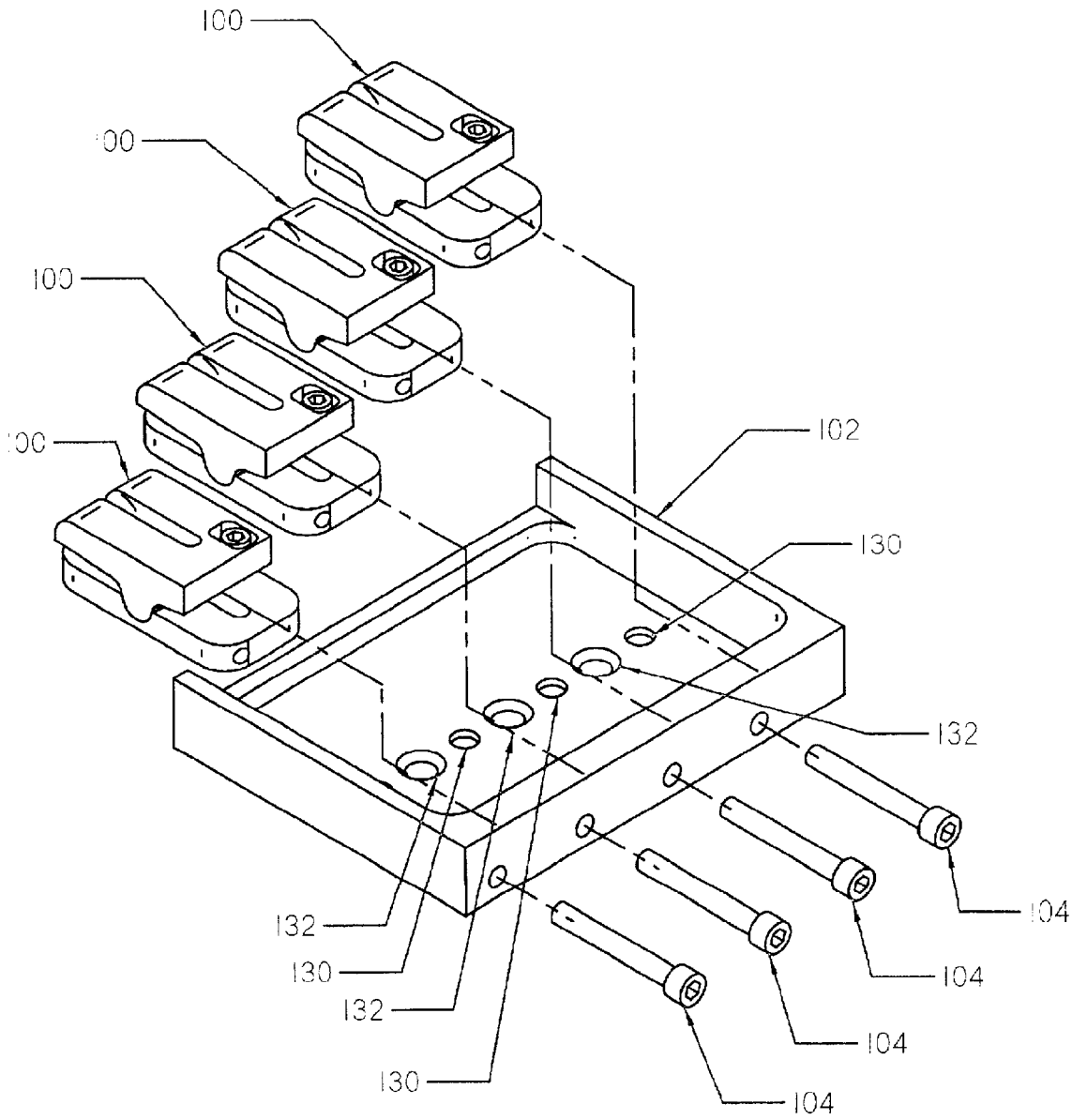
FIG. 3 provides an exploded isometric view of the preferred embodiment of the bridge.

FIGS. 1–3 illustrate the general structure of the inventive bridge. Generally, the bridge comprises a series of adjusters, 100, a base plate, 102, and a length adjusting screw, 104, for each of the adjusters. There is one adjuster for each string on the instrument to which the bridge is fitted and their number can vary as needed. Preferably, the adjusters fit closely into recess, 106, in the base, restricting their lateral movement and limiting their forward and backward movement.

As can be seen, the structure of the adjusters is solid and utilizes relatively large elements in comparison to a traditional adjustable bridge. The interfaces between the elements provide a close fit and solid contact over a large area. The combination of these features provides a rigid support for the string with minimized movement between the elements. This results in reduced dampening action on the string and minimal energy loss in the bridge. This in turn provides improved tone sustaining capability and improved sound transfer to the guitar body, where relevant. The details of the elements will be discussed in more depth below.

Figure 4:
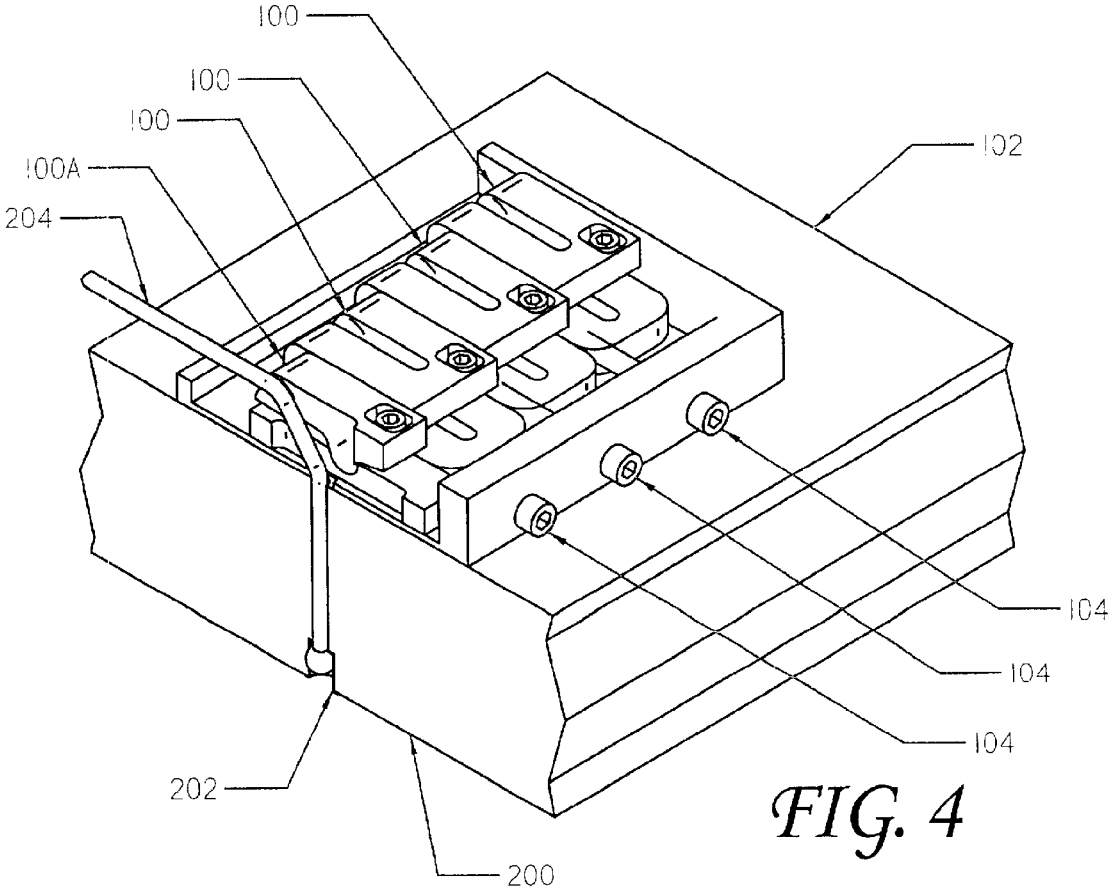
FIG. 4 is a cutaway view illustrating string routing with the preferred embodiment of the bridge for a string through configuration.
Figure 5:
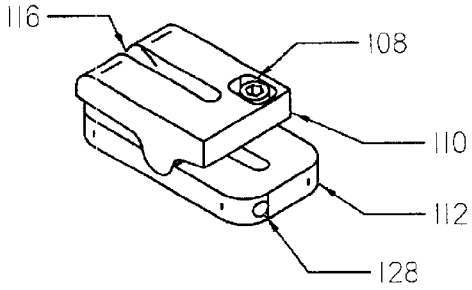
FIG. 5 provides an isometric view of a single adjuster used in the preferred embodiment of the bridge.

FIGS. 4–7 illustrate the two most significant variants on the design. FIGS. 4 & 5 illustrate a bridge which is designed for a "string through" application. The string, 204, passes over an adjuster, 100A, downward through the adjuster and through a hole in the base plate, 102, and through the body of the guitar, 200. The string is retained by cup, 202, which opens to the rear of the guitar.

Figure 6:
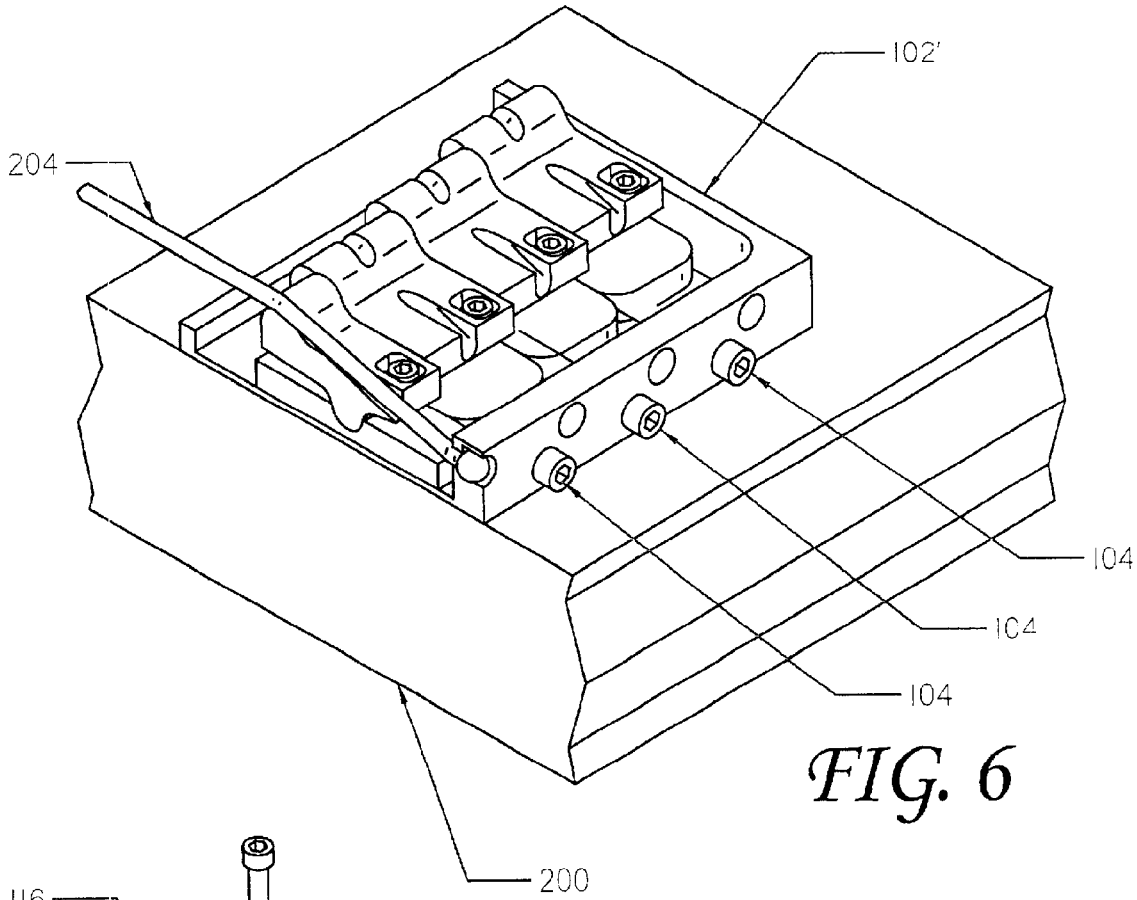
FIG. 6 is a cutaway view illustrating string routing with an alternative embodiment of the bridge for a top mount configuration.
Figure 7:
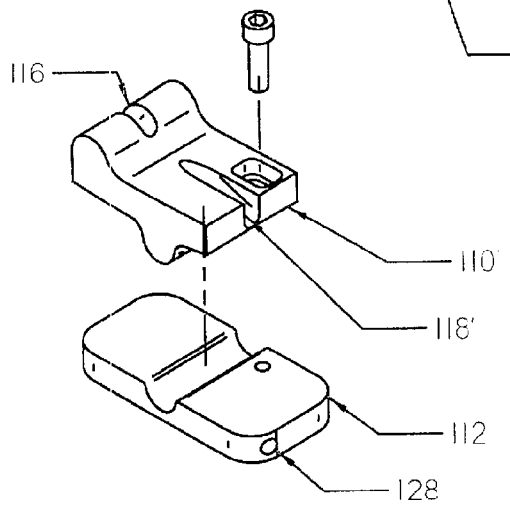
FIG. 7 provides an isometric view of an alternative embodiment of a single adjuster used for a top mount configuration.
Figure 8:
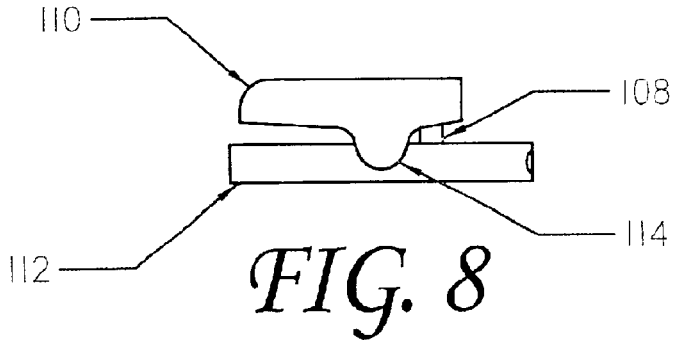
FIG. 8 is a side view of the preferred embodiment of the adjuster.
Figure 9:
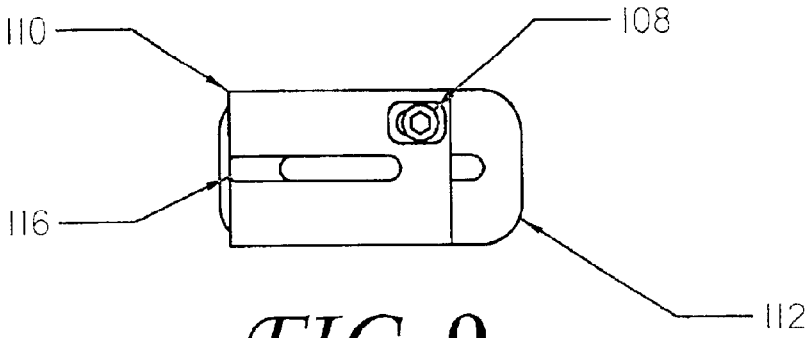
FIG. 9 is a top view of the preferred embodiment of the adjuster.
Figure 10:
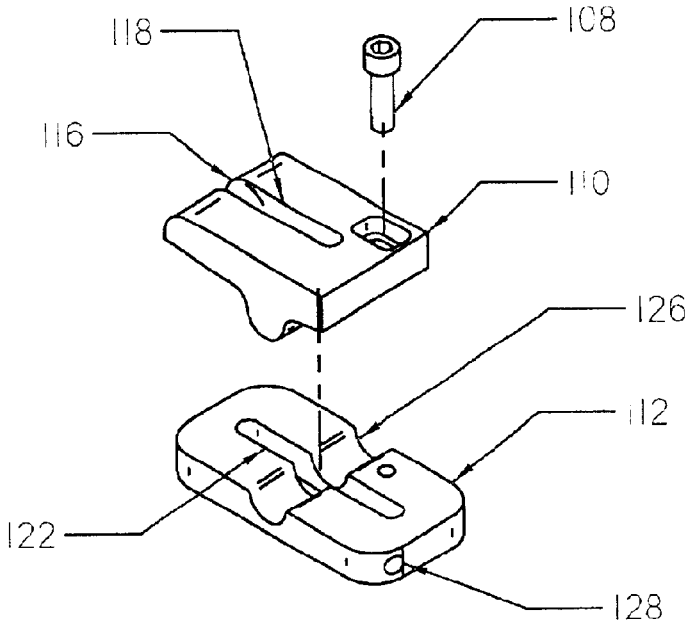
FIG. 10 is an exploded isometric view of the preferred embodiment of the adjuster.

FIGS. 6 & 7 illustrate a bridge adapted for use in a "top mount" application. Rather than passing through the body of the guitar, the string is retained on the front (or top) face of the guitar by a hole or recess in the base plate, 102'. As shown in FIG. 7, a modified adjuster can be used in this embodiment which eliminates the slot in the anvil and which raises the string relative to the adjuster, by raising slot, 116', to decrease the depth of the clearance groove, 118', at the rear of the saddle (providing a more rigid saddle). Clearly some of these features could be eliminated with little or no compromise in performance. If desired a common design could serve both applications and they will be considered to be equivalent herein unless specifically differentiated.

FIGS. 5 & 8–10 illustrate the construction of a single adjuster. The adjuster is supported by the anvil, 112, which rests on the base plate or guitar body. Saddle, 110, rests on the anvil. Height adjusting screw, 108, passes through the saddle and threads into the anvil. The downward forces of the string and the height adjusting screw hold the saddle firmly in contact with the anvil. This differs from the typical prior art arrangement in which the adjusting screw takes the pressure and transfers the sound, as discussed below. Adjusting the length of the height adjusting screw causes the saddle to pivot about the fulcrum, 114, raising and lowering the front end of the saddle where the string bears, in turn raising and lowering the string itself.

Figure 11:
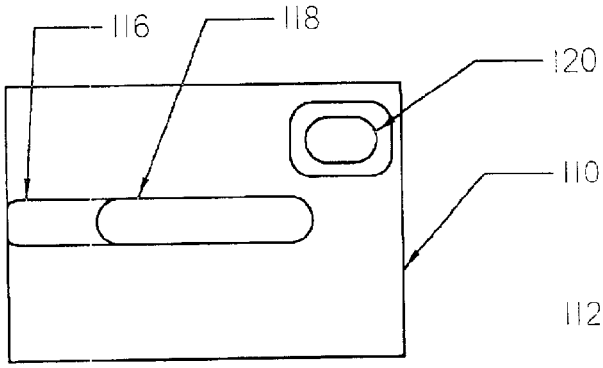
FIG. 11 is a top view of the saddle.
Figure 12:
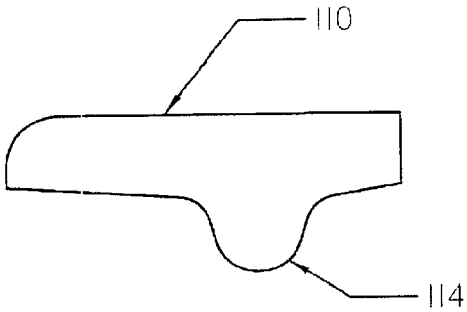
FIG. 12 is a side view of the saddle.
Figure 13:
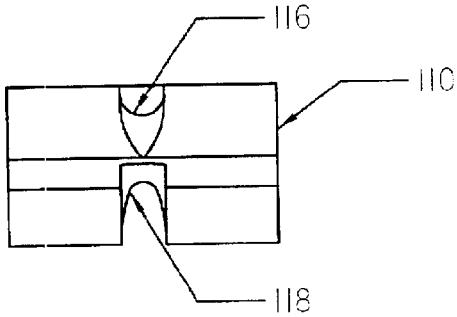
FIG. 13 is a left end view of the saddle.

The details of the saddle are shown more clearly in FIGS. 11–13. String groove, 116, provides a seat for the string. Preferably the string groove is smoothly radiused from the front of the saddle to the clearance slot, 118, in a continuous curve. This eliminates any sharp edges which might bear against the string, causing it to kink or break. Ideally, the lateral profile of the string groove is semi-circular and has a radius which is substantially identical to that of the string. This provides the most secure retention of the string, minimizing energy loss due to friction between the string and the saddle and maximizing sound transfer through the saddle. Clearance slot, 118, allows the string to pass downward through the saddle so that the string only contacts the saddle in one location for a string through application. Fulcrum, 114, has a constant radius cross section along the lower surface so that the saddle pivots about the fulcrum's lateral centerline. This keeps the fulcrum in constant contact with the entire surface of the pivot groove, 126, in the anvil, maximizing rigidity and sound transfer. Preferably, both the fulcrum and the pivot groove extend the full width of the saddle and anvil. Counterbored slot, 120, accepts the height adjusting screw. The slight elongation accommodates the angular variation of the saddle relative to the screw while the counterbore allows the head of the screw to remain below the surface of the saddle throughout the adjustment range. If desired to increase the angular range of movement of the saddle, the taper of the lower surface on the front and rear of the saddle can be increased, the junctures of the fulcrum and the lower surfaces can be undercut, or the edge of the pivot groove in the anvil can be chamfered.

Figure 14:
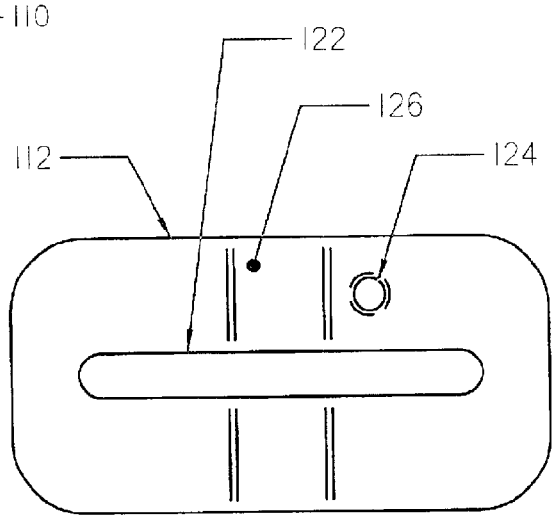
FIG. 14 is a top view of the anvil.
Figure 15:
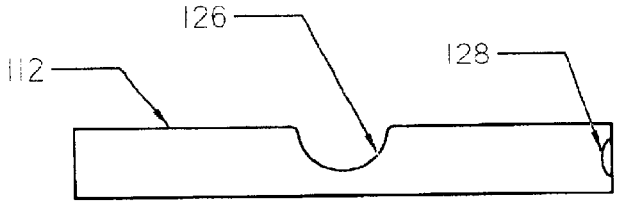
FIG. 15 is a side view of the anvil.

FIGS. 14 & 15 provide a detailed illustration of the anvil, 112. Clearance slot, 122, functions in a similar manner to that in the saddle, allowing the string to pass through the anvil to reach the guitar body. The elongation of the slot, like that in the saddle, allows for forward and backward movement of the adjuster relative to the fixed hole in the base plate and in the guitar body, as the length of the string is adjusted. Pivot groove, 126, receives the fulcrum, 114, of the saddle. The radius of the pivot groove and the fulcrum are substantially equal providing a close fit and a large contact area. This provides both structural rigidity and energy transfer therebetween. The elongated partial cylinder shape of the pivot groove and fulcrum, arranged perpendicular to the length of the string provides the greatest resistance to movement induced by the string tension and to relative axial movement between the saddle and anvil about their vertical axes. The large base provided by the lower surface of the anvil creates a substantial contact area between the anvil and the underlying base plate or guitar body. This provides high resistance to axial movement and good energy transfer to the guitar body. Where the anvil is place in direct contact with the guitar body, the large contact area also helps prevent marring of the surface of the guitar.

Note that, if desired, the fulcrum could be formed on the anvil and the pivot groove formed in the saddle and the same functionality would be achieved. A separate piece, such as a section of rod, could also be used to form a separate fulcrum with both saddle and anvil defining pivot grooves to engage the fulcrum, although degraded performance would be anticipated.

Referring again to FIGS. 5 & 8–10, the height adjustment screw, 108, can be seen to pass through the saddle, 110, and engage the anvil, 112. This places the screw in tension, in contrast to the typical prior art arrangement which uses a screw, or screws, placed in compression to take the majority of the downward force on the adjuster. The present arrange offers significant advantages including directing all of the downward force through the fulcrum and allowing the screw head to remain at a constant height relative to the saddle. In the preferred embodiment, the head is recessed into the saddle, substantially flush with the upper surface of the saddle. This combines with other design features of the inventive bridge to provide a relatively smooth, even surface advantageous to palm muting and avoid snagging clothing as discussed below.

Figure 20:
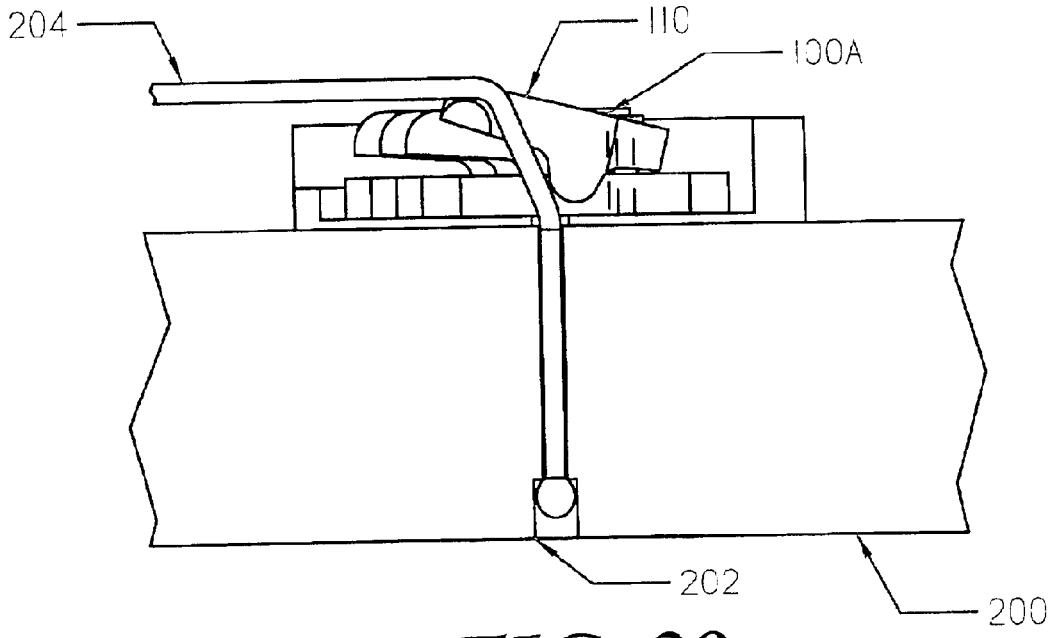
FIG. 20 is a cutaway view of the preferred embodiment showing the saddle in a raised position.
Figure 21:
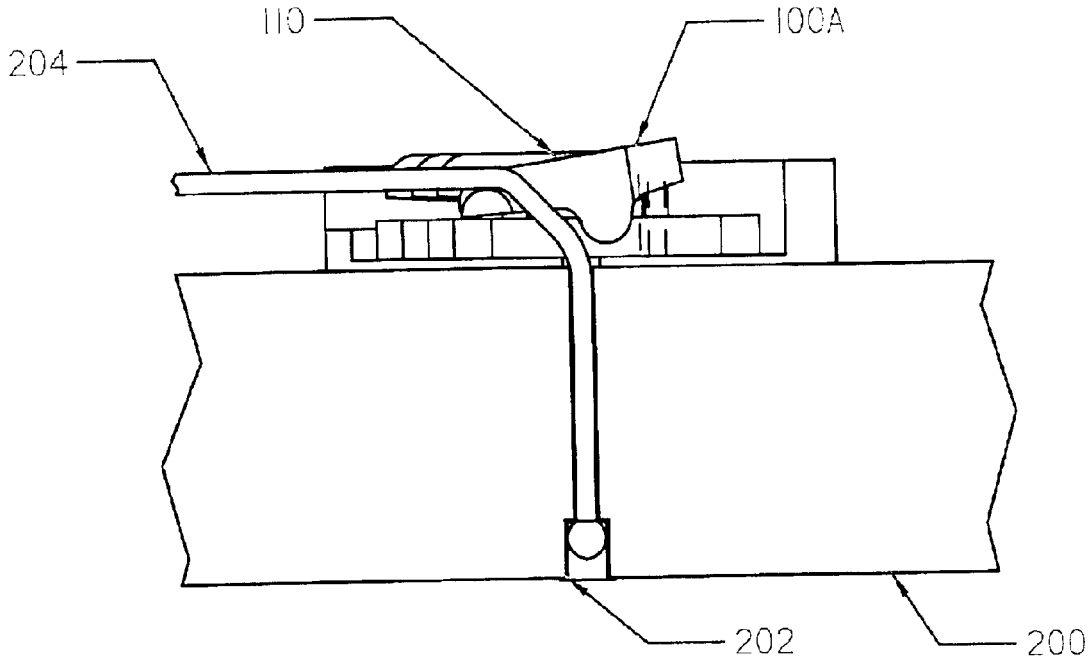
FIG. 21 is a cutaway view of the preferred embodiment showing the saddle in a lowered position.

As illustrated in FIGS. 20 and 21, turning the height adjusting screw in or out of the anvil alters the angle of the saddle, 110, effecting a height adjustment of the string as the forward end of the saddle raises and lowers. This provides the desired height adjustment of the string relative to the frets. The range of adjustment available is determined by the thickness of the saddle and the relative lengths of the two ends of the saddle. As a limiting value, the saddle should be able to lower the string to a point in contact, or nearly so, with the frets. The adjustment range of the height adjustment screw is limited by the thickness of the anvil, into which it threads. If desired, a groove could be formed in the base plate, and/or the guitar body, aligned with and adapted to receive the end of the screw as it extend below the anvil. As a further alternative, the entire bridge can be recessed into the body of the guitar. This would increase the depth available for the elements of the bridge, allowing them to be built to a larger scale, increasing the range of adjustment available or allowing them to be more easily fitted with individual pizo electric pickups.

The base plate, 102 in FIGS. 1–4, serves to mount the bridge to the guitar. It provides an attaching point for the length adjusting screws, supports and contains (in some embodiments) the adjusters, and anchors the strings in a top mount arrangement. In the preferred embodiment the base plate is a single piece, but could be constructed of multiple cooperating pieces. In the preferred embodiment the base plate comprises a bottom plate which defines clearance holes, 130, through which the strings pass and mounting holes, 132, for mounting screws which couple to the guitar body. This arrangement of mounting screws is advantageous where pre-existing holes for a previous bridge may be reused.

Figure 16:
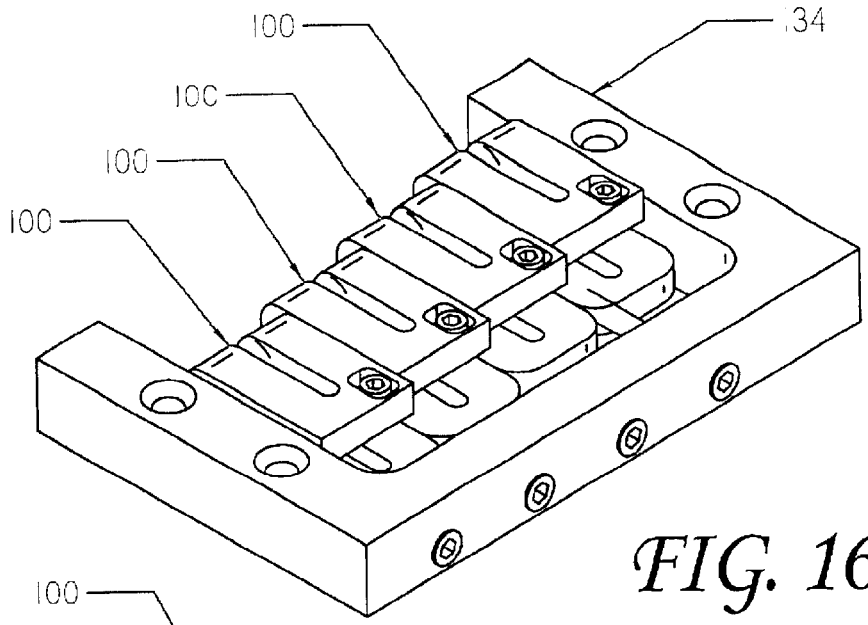
FIG. 16 is an isometric view of an alternative embodiment of the bridge with no bottom plate.
Figure 17:
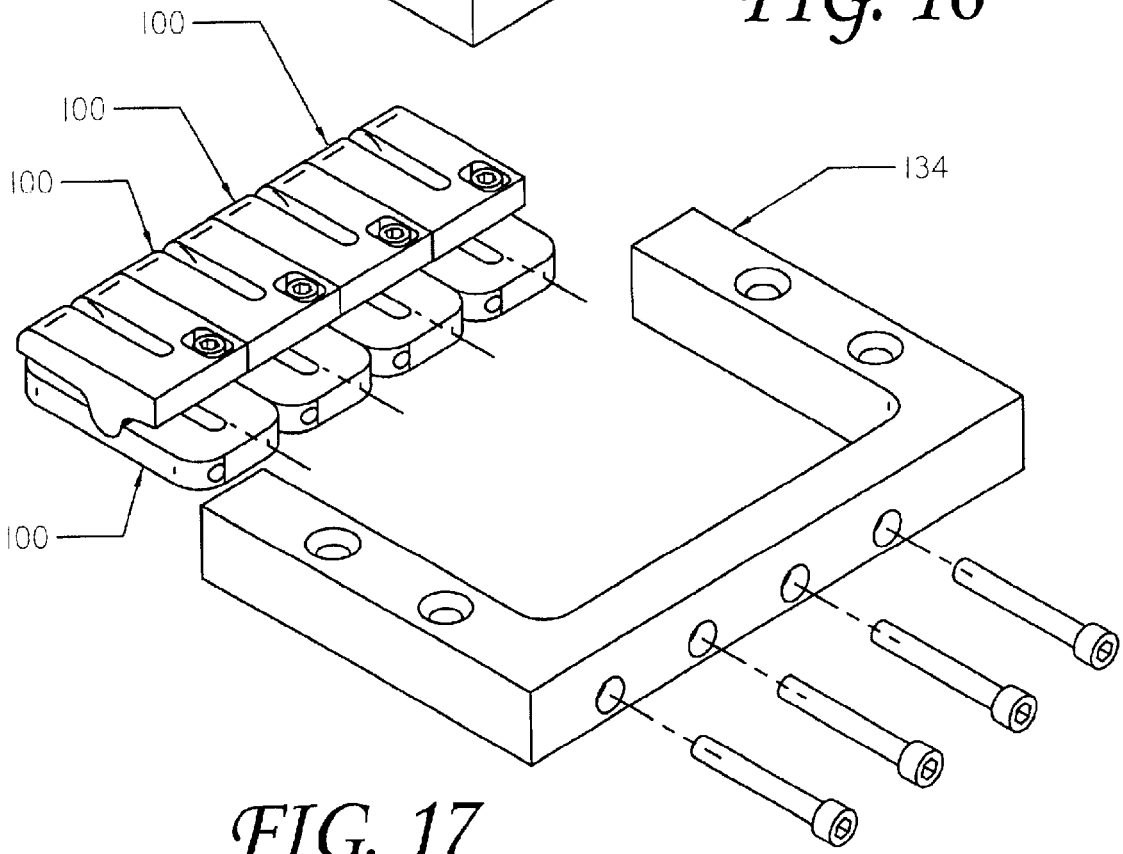
FIG. 17 is an exploded isometric view of an alternative embodiment of the bridge with no bottom plate.

The alternative embodiment of FIGS. 16 & 17 illustrate the placement of the mounting screws in the side rails. The lower surface of the base plate has also been eliminated. This allows the adjusters to be placed in direct contact with the guitar body. This eliminate one element, the base plate, and one interface from the path between the string and the guitar body. This results in a more rigid support for the string and improved energy transfer to the guitar body.

In both of the above embodiments, it is preferable if the distance between the side rails is matched to an even multiple of the width of the adjusters. Where this is done, the set of adjusters is closely received within the opening defined by the side rails, allowing little or no sideways movement, eliminating another way in which the energy from the string could be dissipated.

Figure 18:
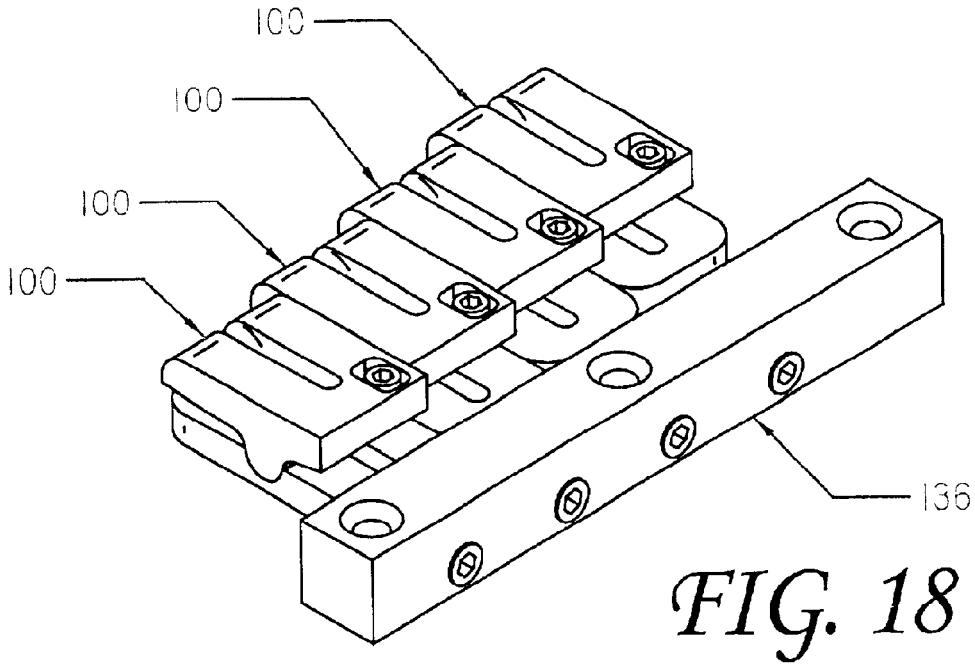
FIG. 18 is an isometric view of an alternative embodiment of the bridge with no bottom plate or side rails.
Figure 19:
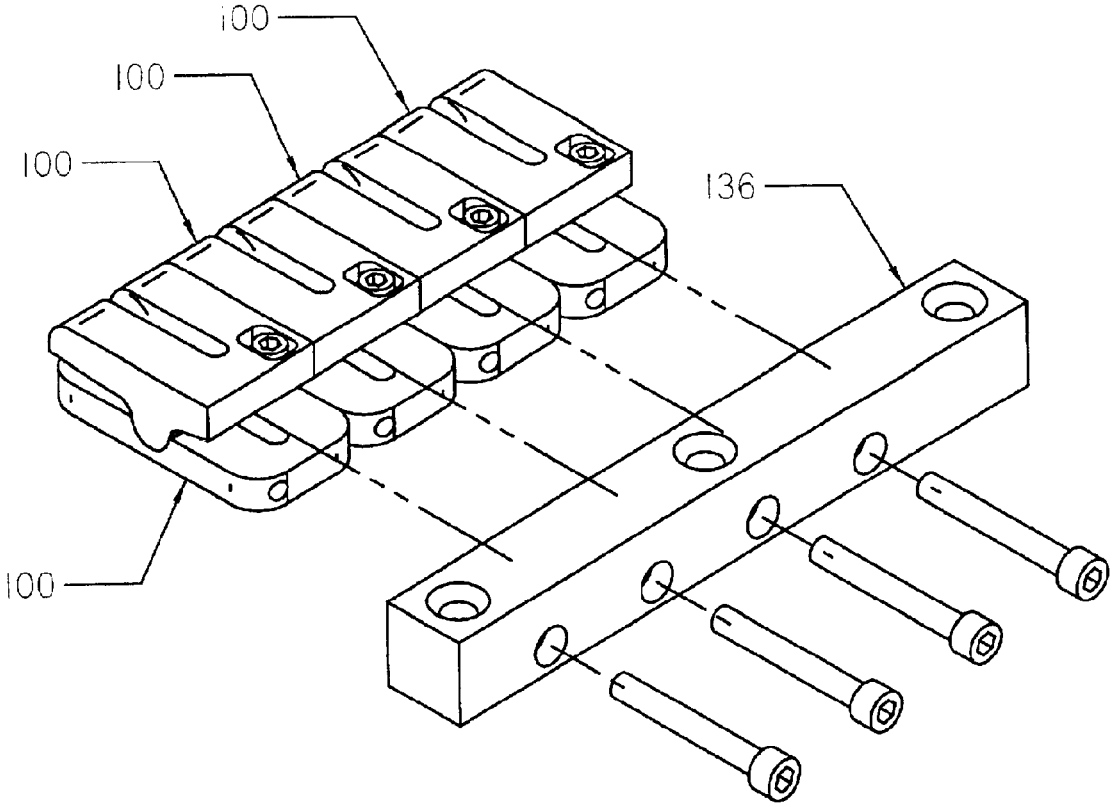
FIG. 19 is an exploded isometric view of an alternative embodiment of the bridge with no bottom plate or side rails.

FIGS. 18 & 19 illustrate an alternative embodiment, 136, wherein the base plate comprises solely the end rail. This is effective since only the end rail takes any stress directly. While somewhat less strong and rigid than the above alternatives, it should provide adequate performance. It offers the advantage of a clean, minimalist appearance which is attractive to some users. As above, this embodiment places the adjusters in direct contact with the guitar body, enabling a more efficient transfer of sound to the guitar body.

Figure 22:
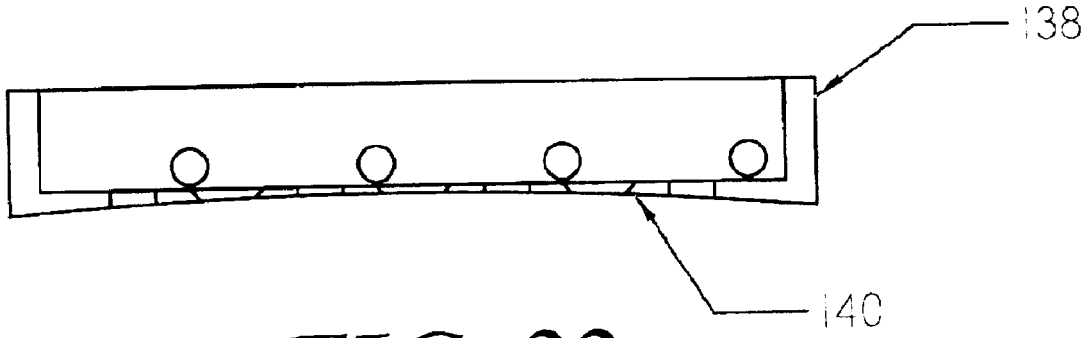
FIG. 22 is an end view of an alternative embodiment of the base plate with a concave lower surface.
Figure 23:
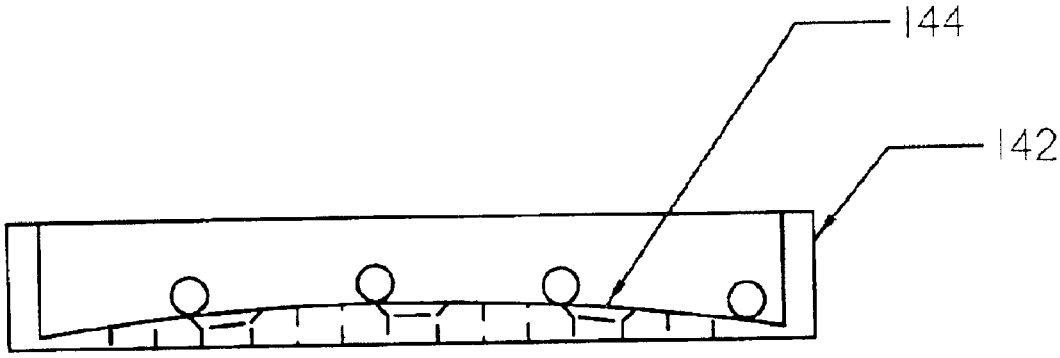
FIG. 23 is an end view of an alternative embodiment of the base plate with a convex upper surface.

The present invention is readily adapted to variations in guitar design. Some guitars are constructed with a slightly convex face. FIG. 22 illustrates an alternative embodiment of the base plate, 138, in which the lower surface, 140, of the bottom plate has been curved to match such a guitar face. Similarly, some guitars use a curved fingerboard, necessitating different heights for each of the strings. While this can be accommodated by the preferred embodiment, by varying the adjuster heights to match, the alternative base plate embodiment, 142, of FIG. 23 can also be used. The curved upper surface, 144, of the bottom plate approximates that of the finger board and supports the adjusters in a curved arrangement. Less adjustment is required to adapt to the finger board, preserving more adjustment range for configuring the strings as desired. In addition, the adjusters are tilted slightly, so that when a height adjustment is made, the string moves perpendicular to the finger board rather than vertically as they would with a flat base plate.

While the illustrated embodiments all use a rectangular base plate, this is not a restriction of the invention. Alternative configurations, such as a parallelogram could also be used without departing from the principles of the invention. This can be advantageous as the adjusted length of the string often increases regularly from the higher to the lower strings. A parallelogram approximating this arrangement would provide for more equal spacing between the adjusters and the end rail and a more equal range of adjustment for the strings.

Clearly alternative means of attaching the base plate to the guitar body, such as adhesives, chemical or ultrasonic welding, etc. as well known in the art are applicable and are considered to be equivalent.

The length adjusting screws, 104 in FIGS. 1–4 and others, pass through the end rail of the base plate and thread into the hole, 128, in the end of the anvil, 112. This allows the relative distance between the adjusters and the end rail to be adjusted by turning the screw. In turn, this change in position alters the length of the string. Altering the length of the string alters the placement of the octave points for that string, allowing them to be positioned over the frets on the finger board. This is necessitated in part because the above height adjustment alters the string length which could shift the octave points out of position. It also allows fine tuning the placement to the individual musician's preference. If preferred, the heads of the screws may be recessed into the base plate as shown in FIGS. 16 & 18. In the preferred embodiment, the length adjusting screws, and related holes, are offset to the side of the adjuster. This avoids a conflict with the string in a top mount arrangement and with the clearance slot in the anvil for a string through arrangement. If desired, the length adjustment screw can be centered by allowing the string to partially wrap around the screw in a top mount or by elongating the anvil relative to the length of the clearance slot in a string through. As a further alternative, the length adjusting screw can be fitted with a biasing spring which pushes the adjuster away from the end rail of the base plate. This has not been found necessary but may offer some slight advantage in adjusting the position of the adjusters.

Advantages

The primary advantages of the present invention are the functional characteristics discussed above. The individual elements are relatively large, providing significant strength and rigidity. The interfaces between the elements, especially the saddle and anvil, are solid and close fitting, minimizing energy loss to friction and movement. The end result of these features is a bridge in which each string is individually adjustable for both height and length while offering increased tone sustain and sound transfer to the soundboard (where needed).

In addition, the present invention provides a bridge which presents a relatively smooth contour to the musician. The upper surfaces of the adjusters are large and substantially flat with recessed height adjusting screws. The base plate also presents smooth surfaces and the length adjusting screws may also be recessed. The result is a bridge with no projections or sharp edges. Since the adjusters are preferably configured to abut each other, and would typically be adjusted to similar heights, they present an almost unbroken surface. This offers advantages in at least two situations. The first is that the musician's sleeve or cuff will often pass over the bridge while the guitar is played. If projections or sharp corners are present, the sleeve may snag on the bridge, interfering with the musician's movement. The second is where a technique known as palm muting is used. Some musicians prefer to place the palm of their hand on the strings in the vicinity of the bridge to selectively mute them during play. Protrusions and sharp edges can make this technique uncomfortable and may even cause minor cuts and scrapes. To further enhance these advantages, the edges and corners of the various elements of the bridge may be further rounded and smoothed and changes such as matching the height of the base plate rails to the nominal height of the adjusters can be incorporated.

While the preferred form of the invention has been disclosed above, alternative methods of practicing the invention are readily apparent to the skilled practitioner. The above description of the preferred embodiment is intended to be illustrative only and not to limit the scope of the invention.

I claim:

1. An adjuster for attaching a string to the bridge of a stringed instrument, said adjuster comprising:

a) a saddle with first and second opposing ends and a longitudinal axis passing through said ends, having a protruding fulcrum extending perpendicular to said longitudinal axis, and said saddle defining a string groove adapted to receive the string proximate said first end;

b) an anvil, defining a pivot groove adapted to receive said fulcrum; and c) means for adjusting the relative angle of said anvil and said saddle about said fulcrum, whereby the distance from said string groove to said anvil is varied.

2. The adjuster of claim 1 wherein said fulcrum extends the full width of the saddle and said pivot groove extends the full width of the anvil.

3. The adjuster of claim 1 wherein each of said fulcrum and said pivot groove comprises an arcuate section with substantially equal radii.

4. The adjuster of claim 1 wherein said string groove comprises a semi-circular region having a radius substantially equal to the radius of the string.

5. The adjuster of claim 1 wherein said saddle further defines a clearance slot therethrough in a plane substantially parallel to said longitudinal axis adapted to allow passage of the string.

6. The adjuster of claim 5 wherein said anvil further defines a clearance slot therethrough adapted to allow passage of the string, said anvil clearance slot substantially aligned with said saddle clearance slot when said fulcrum is positioned in said pivot groove.

7. The adjuster of claim 1 wherein said means for adjusting comprises an adjusting screw passing through said saddle proximate said second end and threadedly engaging said anvil.

8. An adjuster for attaching a string to the bridge of a stringed instrument, said adjuster comprising:

a) a saddle, and said saddle defining a lateral pivot groove, a string groove adapted to receive the string proximate a first end of said saddle, and a clearance slot;

b) an anvil with a longitudinal axis, having a protruding fulcrum extending perpendicular to said longitudinal axis adapted to fit said pivot groove; and c) an adjusting screw interconnecting said anvil and said saddle proximate a second, opposite end of said saddle, for pivoting said anvil and said saddle about said fulcrum, whereby the distance from said string groove to said anvil is varied.

9. An adjustable bridge for an instrument having plural strings, said bridge comprising:

a) a base plate connectable to the body of the instrument, said base plate comprising a bottom plate adapted to contact the body of the instrument;

b) plural adjusters, one for each string, each supported by said bottom plate, and each comprising:

i) an anvil, ii) a saddle, pivotally supported by said anvil and defining a string groove adapted to receive the string; and iii) means for adjusting the relative angle of said anvil and said saddle about said pivot whereby the distance between said string groove and said anvil can be varied;

c) plural length adjusting screws, one connecting each of said adjusters to a section of said base plate, whereby rotation of said screws relative to said adjusters moves said adjusters toward or away from said base plate section to separately adjust the length of each string;

wherein said bottom plate has a somewhat concave lower surface to adapt said bridge to stringed instruments having convex bodies.

10. An adjustable bridge for an instrument having plural strings, said bridge comprising:

a) a base plate connectable to the body of the instrument, said base plate comprising a bottom plate adapted to contact the body of the instrument;

b) plural adjusters, one for each string, each supported by said bottom plate, and each comprising:

i) an anvil, ii) a saddle, pivotally supported by said anvil and defining a string groove adapted to receive the string; and iii) means for adjusting the relative angle of said anvil and said saddle about said pivot whereby the distance between said string groove and said anvil can be varied;

c) plural length adjusting screws, one connecting each of said adjusters to a section of said base plate, whereby rotation of said screws relative to said adjusters moves said adjusters toward or away from said base plate section to separately adjust the length of each string;

wherein said bottom plate has a somewhat convex upper surface to position said adjusters in an arcuate pattern.

11. An adjustable bridge for an instrument having plural strings, said bridge comprising:

a) a base plate connectable to the body of the instrument;

b) plural adjusters, one for each string, each comprising:

i) an anvil, ii) a saddle, pivotally supported by said anvil and defining a string groove adapted to receive the string; and iii) means for adjusting the relative angle of said anvil and said saddle about said pivot whereby the distance between said string groove and said anvil can be varied;

c) plural length adjusting screws, one connecting each of said adjusters to a section of said base plate, whereby rotation of said screws relative to said adjusters moves said adjusters toward or away from said base plate section to separately adjust the length of each string;

wherein said base plate defines an open region in which said adjusters are positioned in direct contact with the instrument body.

12. An adjustable bridge for an instrument having plural strings, said bridge comprising:

a) a base plate connectable to the body of the instrument;

b) plural adjusters, one for each string, each comprising:

i) an anvil, ii) a saddle, pivotally supported by said anvil and defining a string groove adapted to receive the string; and iii) means for adjusting the relative angle of said anvil and said saddle about said pivot whereby the distance between said string groove and said anvil can be varied;

c) plural length adjusting screws, one connecting each of said adjusters to a section of said base plate, whereby rotation of said screws relative to said adjusters moves said adjusters toward or away from said base plate section to separately adjust the length of each string;

wherein each of said adjusters has a width and said base plate comprises two spaced apart parallel side rails defining therebetween a space having a width substantially equal to the combined width of said plural adjusters whereby said adjusters are closely received within said space with lateral movement of said adjusters substantially eliminated.

* * * * *